US008062442B1

(12) United States Patent
Clausen, III et al.

(10) Patent No.: US 8,062,442 B1
(45) **Date of Patent: *Nov. 22, 2011**

(54) SAFE, IN SITU METHODOLOGIES FOR THE DESTRUCTION OF TRIACETONE TRIPEROXIDE AND OTHER EXPLOSIVE PEROXIDES

(75) Inventors: Christian Clausen, III, Chuluota, FL (US); Cherie L. Geiger, Geneva, FL (US); Michael Sigman, Oviedo, FL (US); Rebecca Fidler, Orlando, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 1075 days.

This patent is subject to a terminal disclaimer.

(21) Appl. No.: 11/732,402

(22) Filed: Apr. 3, 2007

Related U.S. Application Data

(60) Provisional application No. 60/789,519, filed on Apr. 5, 2006.

(51) Int. Cl.

| | |
|---|---|
| ***C06B 45/00*** | (2006.01) |
| ***C06B 45/02*** | (2006.01) |
| ***D03D 23/00*** | (2006.01) |
| ***D03D 43/00*** | (2006.01) |

(52) U.S. Cl. ..... 149/2; 149/21; 149/108.2; 149/108.4; 149/108.8; 149/109.4

(58) Field of Classification Search ..... 149/2, 21, 149/108.2, 108.4, 108.8, 109.4
See application file for complete search history.

(56) References Cited

U.S. PATENT DOCUMENTS

| | | | | |
|---|---|---|---|---|
| 4,641,566 | A * | 2/1987 | Pomeroy | 89/1.13 |
| 4,908,323 | A * | 3/1990 | Werner | 436/135 |
| 5,434,336 | A * | 7/1995 | Adams et al. | 588/313 |
| 6,664,298 | B1 * | 12/2003 | Reinhart et al. | 516/22 |

(Continued)

FOREIGN PATENT DOCUMENTS

WO WO/99/73846 9/1999

OTHER PUBLICATIONS

Nicholas A. Milas, Aleksandar Golubovic, "Studies in Organic Peroxides. XXIV. Preparation, Separation and Identification of Peroxides Derived from Diethyl Ketone and Hydrogen Peroxide," J. Am. Chem. Soc., (1959), vol. 82, pp. 3361-3364.

(Continued)

*Primary Examiner* — James McDonough
(74) *Attorney, Agent, or Firm* — Brian S. Steinberger; Joyce P. Morlin; Law Offices of Brian S. Steinberger, P.A.

(57) ABSTRACT

Triacetone triperoxide (TATP) and other explosives of the peroxide family are safely degraded in situ. Nano and micron size metal particles in an elemental state include pure iron and magnesium or iron and magnesium particles that are mechanically alloyed with palladium and nickel. The metal particles are used in both the elemental state and in emulsions that are made from water, a hydrophobic solvent, such as corn oil, and a food-grade nonionic surfactant. The neat metals and emulsified zero valent metals (EZVM) safely degrade TATP with the major degradation product being acetone. The EZVM system absorbs and dissolves the TATP into the emulsion droplets where TATP degradation occurs. EZVM systems are ideal for degrading dry TATP crystals that may be present on a carpet or door entrance. Both the neat metal system and the emulsion system (EZVM) degrade TATP in an aqueous slurry.

19 Claims, 8 Drawing Sheets

U.S. PATENT DOCUMENTS

| | | | | |
|---|---|---|---|---|
| 6,767,717 | B1 * | 7/2004 | Itzhaky et al. | 435/28 |
| 6,773,674 | B2 * | 8/2004 | Bannister et al. | 422/83 |
| 7,077,044 | B2 * | 7/2006 | Badger et al. | 86/50 |
| 7,159,463 | B2 * | 1/2007 | Dayagi et al. | 73/579 |

OTHER PUBLICATIONS

Cahn, R.P., Li, N. N., "Separation of Phenol from Waste Water by the Liquid Membrane Technique," Separation Science, vol. 9(6), pp. 505-519, 1974.

Anthony J. Bellamy, "Triacetone Triperoxide: Its Chemical Destruction," J Forensic Sci., (1999), vol. 44 (3), pp. 603-608.

Jimmie C. Oxley, James L. Smith, Heng Chen, "Decomposition of a Multi-Peroxidic Compound: Triacetone Triperoxide (TATP)," Propellants, Explosives, Pyrotechnics, vol. 27, pp. 209-216, (2002).

F. Dubnikova, R. Kosloff, Y. Zeiri, and Z. Karpas, "Novel Approach to the Deteciton of Triacetone Triperoxide (TATP): Its Structure and Its Complexes with Ions," J. Phys. Chem. A., vol. 106, (2002) pp. 4951-4956.

Rasmus Schulte-Ladbeck, Peter Kolla, and Uwe Karst, "Trace Analysis of Peroxide-Based Explosives," Anal. Chem. (2003), vol. 75, No. 4, pp. 731-735.

C. Geiger, C. Clausen, K. Brooks, C. Clausen, C. Huntley, L. Filipek, D. Reinhar, J. Quinn,, T. Krug, S. O''Hara, D. Major, Nanoscale and Microscale Iron Emulsions for Treating DNAPL, American Chemical Society Books, *Innovative Strategies for the Remediation of Chlorinated Solvents and DNAPL in the Subsurface*. Series 837, (2003) Chapter 9, pp. 132-140.

K. Milum, C. Geiger, C. Clausen, R. DeVor, J. Quinn, "In Situ Heavy Metal Contaminant Removal Using Emulsified Iron," Proceedings of the Fourth International Conference on Remediation of Chlorinated and Recalcitrant Compounds, Paper 4D-04, (2004) 6 pages.

J. Quinn, S. O'Hara, T. Krug, C. Geiger, C. Clausen, "Evaluating the Distribution of Emulsified Zero-Valent Iron for Four Different Injection Techniques," Proceedings of the Fourth International Conference on Remediation of Chlorinated and Recalcitrant Compounds, Paper 5B-08, (2004) 8 pages.

J. Quinn, C. Geiger, C. Clausen, K. Brooks, C. Coon, S. O'Hara, T. Krug, D. Major, W-S Yoon, A. Gavaskar, T. Holdsworth, "Field Demonstration of DNAPL Dehalogenation Using Emulsified Zero-Valent Iron," Environ. Sce. Technol., (2005), vol. 39, pp. 1309-1318.

* cited by examiner

SAFE, IN SITU METHODOLOGIES FOR THE DESTRUCTION OF TRIACETONE TRIPEROXIDE AND OTHER EXPLOSIVE PEROXIDES

This invention claims the benefit of priority based on the U.S. Provisional Application Ser. No. 60/789,519 filed Apr. 5, 2006.

STATEMENT REGARDING FEDERALLY SPONSORED RESEARCH OR DEVELOPMENT

The subject invention was made with government support under National Aeronautics and Space Administration (NASA) Kennedy Space Center Contract number NAG10312. The U.S. government has certain rights in this invention.

FIELD OF THE INVENTION

This invention relates to the degradation of explosive materials and in particular to a composition of matter, a method of making and using the composition of matter for the degradation of the peroxide family of explosives.

BACKGROUND AND PRIOR ART

In the 19$^{th}$ century a German scientist, R. Wolffenstein, discovered acetone peroxide using an inorganic acid as a catalyst and received a patent on its use as an explosive. Acetone peroxide is noted for its instability and thus, for more than 100 years was not used militarily or commercially. However, in the 21$^{st}$ century man's evil twin has embraced acetone peroxide as a weapon of choice for terrorist activities and suicide bombers.

Triacetone triperoxide (TATP) and other explosives of the peroxide family are used extensively by terrorist organizations around the world because they are easy to prepare and very difficult to detect. TATP can be made from common household items such as drain cleaner (sulfuric acid —$H_2SO_4$), hydrogen peroxide ($H_2O_2$), and acetone ($CH_3COCH_3$), a nail polish remover and common organic solvent. The low cost of the reactants and the ease with which they can be obtained lead to the manufacture of TATP by those without the resources to manufacture or buy more sophisticated explosives.

The acid-catalyzed peroxidation of acetone produces a mixture of dimeric and trimeric forms. The trimer is the more stable form, but not much more so than the dimer. All forms of acetone peroxide are insoluble in water and very sensitive to initiation. Organic peroxides are sensitive, dangerous explosives. The military does not use them because there are many better alternatives. For people who synthesize homemade explosives, there are far safer alternatives. Even nitroglycerin is not as sensitive as acetone peroxide. TATP is highly unstable and sensitive to heat and friction and is well deserving of the nickname, "Mother of Satan."

Global security, travel, human and animal life are threatened. The world population is at increased risk of adverse outcomes, including constant fear, terror and death.

As an illustration of the gravity of the situation, on Dec. 22, 2001, American Airlines Flight 53, carrying a crew of 14 and a passenger complement of 184, including "shoe bomber" Richard Reid, departed Charles de Gaulle Airport in Paris, France, bound for Miami, Fla. Approximately one and a half hours into the flight, a flight attendant smelled what she thought was a burnt match. After the flight attendant determined that it was coming from where Reid was seated, she confronted Reid, at which time he put a match into his mouth. The flight attendant alerted the captain over the intercom system. Reid went on to light another match in an apparent attempt to set fire to his shoe. The flight attendant then noticed a wire protruding from the shoe. A struggle ensued among several of the flight attendants, passengers and Reid. Ultimately Reid was subdued and restrained for the remainder of the flight. The flight was diverted for landing to Boston's Logan International Airport where Reid was taken into federal custody. Later, analysis by the FBI laboratory in Washington determined that there were two functional improvised explosive devices hidden in Reid's shoes made of the explosive material triacetone triperoxide, known as "TATP," and other components. Richard Reid's shoe had 8 or 10 ounces of triacetone triperoxide and PETN, a high grade military plastic explosive.

The instability of triacetone triperoxide, as mentioned earlier, makes the remediation of a contaminated area a challenging problem. Thus, the best solution is to use a methodology wherein the TATP is degraded in place, to the point where it is safe to remove and/or that it is completely degraded. Such a methodology would have global demand and could be used to abate the crises caused by "shoe bombers" on airplanes or "suicide bombers" in hotels, restaurants or on the streets.

The following US Patents are related to degradation or removal of deleterious materials, including explosives.

U.S. Pat. No. 4,641,566 to Pomeroy teaches an in situ method for detecting buried land mines by non-destructive means involving the spraying of a suspected area with a leach of ionized metal and leaching the ionized metal into the soil to leave a metallic concentrate on an impervious object, such as a plastic mine; then, scanning the area with a metal detector.

U.S. Pat. No. 4,908,323 to Werner discloses a method for determining organic peroxides in aqueous and organic solutions using a peroxide detecting amount of a titanium (IV) compound.

U.S. Pat. No. 5,434,336 to Adams et al. describes an in situ process for the destruction of explosives by heating in the presence of elemental sulfur at temperatures below their spontaneous decomposition temperatures.

U.S. Pat. No. 6,664,298 to Reinhart et al. describes the in situ use of a zero-valent metal emulsion to dehalogenate solvents, such as, trichloroethylene (TCE) and other halogentated hydrocarbons that contaminate ground water and soil environments. The preferred zero-valent metal particles are nanoscale and microscale iron particles. U.S. Pat. No. 6,767,717 to Itzhaky et al. describes a method of detecting a peroxide-based explosive in a sample suspected of having such an explosive; the method includes dissolving the sample in an organic solvent, then contacting the solution with an aqueous solution of a strong acid capable of decomposing the explosive to release hydrogen peroxide, and further contacting the mixture with a peroxidase enzyme to produce a pronounced change in the color of the substrate or its color intensity.

U.S. Pat. No. 6,773,674 to Bannister et al. describes methods and systems for detecting the presence of an energetic material, such as triacetone triperoxide (TATP), in a sample which is known to have the energetic material using thermal analysis for detecting and identifying explosives and other controlled substances. This method requires moving the explosive materials to a laboratory with appropriate analytical equipment.

U.S. Pat. No. 7,077,044 to Badger et al. discloses a method for bioremediating undetonated explosive devices by mixing an explosive mixture with microorganisms.

U.S. Pat. No. 7,159,463 to Dayagi et al. discloses a sensitive and selective method and device for the detection of trace amounts of a substance. A piezoelectric crystal element is used in a sensor device for identifying at least one foreign material from the environment.

WO1999/043846 to Keinan et al. discloses a method and kit for the detection of explosives. The method relies on the decomposition of TATP in the presence of concentrated aqueous sulfuric acid to produce hydrogen peroxide, which is detected by horseradish peroxidase and a color-change reagent.

J. A. Bellamy in *J. Forensic Science* 1999, 44(3), 603-608 reports that solutions of TATP in acetone and other organic solvents have been known to detonate, although solutions in toluene appear to be somewhat stable. It is therefore a risky proposition to dissolve the explosive in organic solvent in an attempt to remove it if no remediaton step is involved.

Irradiation with UV light has been used as a method of decomposing TATP in a detection scheme involving horseradish peroxidase/indicator combination as reported by R. Shulte-Ladbeck, et al. in "Trace Analysis of Peroxide-Based Explosives" *Analytical Chemistry* 2003, 75, 731-735.

The thermal decomposition of TATP has been found to have an activation energy which is within the reasonable expectation for a unimolecular decomposition initiated by a peroxide bond homolysis according to J. C. Oxley et al. in "Decomposition of a Multi-Peroxidic Compound Triacetone Triperoxide (TATP)" *Propellants, Explosives, Pyrotechnics,* 2002, 27, 209-216. Thermal decomposition of TATP in refluxing toluene has been found to be a slow process as reported by N. A. Milas et al. in "Studies in Organic Peroxides XXIV. Preparation, Separation and Identification of Peroxides Derived from Diethyl Ketone and Hydrogen Peroxide." *J. Am. Chem. Soc.* 1959, 82, 3361-3364.

The complexation of TATP with ions was investigated by F. Dubnikova, et al. and many ions are calculated to form stable complexes with the explosive, as reported in "Novel Approach to the Detection of Triacetone Triperoxide (TATP): Its Structure and Its Complexes with Ions" J. Phys. Chem. A2002, 106, 4951-4956.

Further research is available on the use of nano-size elemental metal particles, such as, iron in emulsion systems capable of degrading chlorinated hydrocarbons in a controlled manner, the use of nanometal particles in emulsion systems where the reductive reactions take place within an emulsion droplet and where the hydrophilic and hydrophobic properties of the skin of the droplet can be controlled to a level so as to facilitate the entrance of the molecule of choice that is to be degraded. See C. L. Geiger, et al. "Nanoscale and Microscale Iron Emulsions for Treating DNAPL." in: *Innovative Strategies for the Remediation of Chlorinated Solvents and DNAPL in the Subsurface*. Series 837, 2002, ACS Books, Washington D.C. Jacqueline Quinn, et al. "Evaluating The Distribution Of Emulsified Zero-Valent Iron For Four Different Injection Techniques," *Remediation of Chlorinated and Recalcitrant Compounds* 2004, May 2004. Battelle Press, ISBN #1-57477-132-9. Jacqueline Quinn, et al. "Field Demonstration of DNAPL Dehalogenation Using Emulsified Zero-Valent Iron," 2005, *Environ. Sci. Technol.* 2005; 39(5); 1309-1318.

Kristen Milum, et al. in "In Situ Heavy Metal Contaminant Removal Using Emulsified Iron," *Remediation of Chlorinated and Recalcitrant Compounds* 2004, May 2004. Battelle Press, ISBN #1-57477-132-9 discuss various complexing agents that can be added along with nano-size metal particles into the emulsion system.

Collectively, the above references do not provide a composition of matter and in situ methodologies that safely degrade triacetone triperoxide (TATP) and other organic peroxides that are "homemade" weapons of choice used by 21$^{st}$ century terrorists and extremists. There is a great need for a composition and method that provides safe and effective means for in situ degradation of explosive materials; the present state of the art does not meet this need.

SUMMARY OF THE INVENTION

The first objective of the present invention is to provide a composition of matter and method for safely degrading triacetone triperoxide (TATP) and other explosive peroxides.

The second objective of the present invention is to provide a composition of matter and method for in situ degradation of triacetone triperoxide (TATP) and other explosive peroxides.

The third objective of the present invention is to provide a composition of matter that is an emulsion of a zero-valent metal that can be applied to triacetone triperoxide (TATP) deposits by spraying.

The fourth objective of the present invention is to provide a composition of matter and method for degrading triacetone triperoxide in situ without mixing or agitation.

The fifth objective of the present invention is to provide a composition of matter and method for safely degrading triacetone triperoxide (TATP) wherein nanoscale metal particles are encapsulated in emulsion droplets with a spherical hydrophobic skin and an aqueous hydrophilic interior and the nanoscale particles are contained in the aqueous interior sphere.

A preferred composition of matter useful in degrading explosive peroxides is produced by combining a plurality of nano and micron sized metal particles in the elemental state with a liquid medium that disperses and facilitates contact between an explosive peroxide and the plurality of metal particles.

It is also preferred that the plurality of nano and micron sized metal particles is selected from the group consisting of iron, magnesium, copper, zinc and mixtures thereof. The more preferred plurality of nano and micron sized metal particles are bimetallic alloys of an elemental metal and a metal hydrogenation catalyst. The preferred bimetallic alloy is selected from at least one of: iron palladium (FePd), iron nickel (FeNi), magnesium palladium (MgPd), and magnesium nickel (MgNi).

The preferred liquid medium is selected from the group consisting of only water or an emulsion droplet comprising water, a hydrophobic solvent and a nonionic surfactant. A preferred liquid medium is water. A more preferred liquid medium is an emulsion droplet.

The preferred hydrophobic solvent of the emulsion droplet is selected from the group consisting of vegetable oil, d-limonene and toluene. A preferred vegetable oil is corn oil. The preferred nonionic surfactant in the emulsion droplet is a food-grade surfactant selected from the group consisting of polyoxyethylene sorbitan monooleate and sorbitan trioleate.

The preferred formulation of the reactive emulsion system consists of approximately 45% water, approximately 37% solvent, approximately 2% surfactant and approximately 16% metal particles, whereby all percents are by weight.

The preferred peroxide explosive degraded by the composition of matter of the present invention is triacetone triperoxide.

A preferred method of degrading an explosive peroxide in situ, includes contacting an explosive peroxide with a composition of matter consisting of a plurality of nano and micron sized metal particles in an elemental state with a liquid medium that disperses and facilitates contact between the explosive peroxide and the plurality of metal particles.

In the preferred method, the plurality of nano and micron sized metal particles is selected from the group consisting of iron, magnesium, copper, zinc and mixtures thereof. The preferred plurality of nano and micron sized metal particles further comprise bimetallic alloys of an elemental metal and a metal hydrogenation catalyst. The preferred bimetallic alloy is selected from at least one of: iron palladium (FePd), iron nickel (FeNi), magnesium palladium (MgPd), and magnesium nickel (MgNi).

The preferred liquid medium is selected from the group consisting of only water or an emulsion droplet comprising water, a hydrophobic solvent and a nonionic surfactant. The preferred liquid medium is water. The more preferred liquid medium is an emulsion droplet.

The preferred hydrophobic solvent of the emulsion droplet is selected from the group consisting of vegetable oil, d-limonene and toluene. The preferred vegetable oil is corn oil. The preferred nonionic surfactant is of food-grade quality and is selected from the group consisting of polyoxyethylene sorbitan monooleate and sorbitan trioleate.

The more preferred composition of matter for degrading explosive peroxides consists of approximately 45% water, approximately 37% solvent, approximately 2% surfactant and approximately 16% metal particles, whereby all percents are by weight.

The preferred explosive peroxide for degradation by the composition of matter of the present invention is triacetone triperoxide.

It is preferred that a plurality of neat nano and micron sized metal particles in an elemental state with reductive properties be used to facilitate safe, in situ degradation of an explosive peroxide when there is contact between the neat metal particles and the explosive peroxide.

The preferred metal of the metal particles is selected from the group consisting of iron, magnesium, copper, zinc and mixtures thereof. It is more preferred that the plurality of metal particles comprises bimetallic alloys of an elemental metal and a metal hydrogenation catalyst. The most preferred bimetallic alloy is selected from at least one of: iron palladium (FePd), iron nickel (FeNi), magnesium palladium (MgPd), and magnesium nickel (MgNi); the preferred explosive peroxide being degraded by the plurality of metal particles is triacetone triperoxide.

A preferred method for safely degrading an explosive peroxide in situ includes contacting an explosive peroxide with a plurality of neat nano and micron sized metal particles in an elemental state. The preferred plurality of nano and micron sized metal particles is selected from the group consisting of iron, magnesium, copper, zinc and mixtures thereof. The plurality of nano and micron sized metal particles further comprise bimetallic alloys of an elemental metal and a metal hydrogenation catalyst. The more preferred bimetallic alloy is selected from at least one of: iron palladium (FePd), iron nickel (FeNi), magnesium palladium (MgPd), and magnesium nickel (MgNi).

Further objects and advantages of this invention will be apparent from the following detailed description of a presently preferred embodiment, which is illustrated in the accompanying figures.

DESCRIPTION OF THE PREFERRED EMBODIMENT

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

It would be useful to discuss the meanings of some words and acronyms used herein and their application before discussing the composition of matter and method of using and making the same.

"Acetone peroxide" is a generic term for the family of explosive peroxides consisting of both dimer and trimer forms.

DADP is diacetone diperoxide the dimeric form of acetone peroxide.

TATP means triacetone triperoxide the trimeric form of acetone peroxide and the form commonly used as a "homemade" explosive.

EZVM means emulsified zero valent metal.

Figure 1:
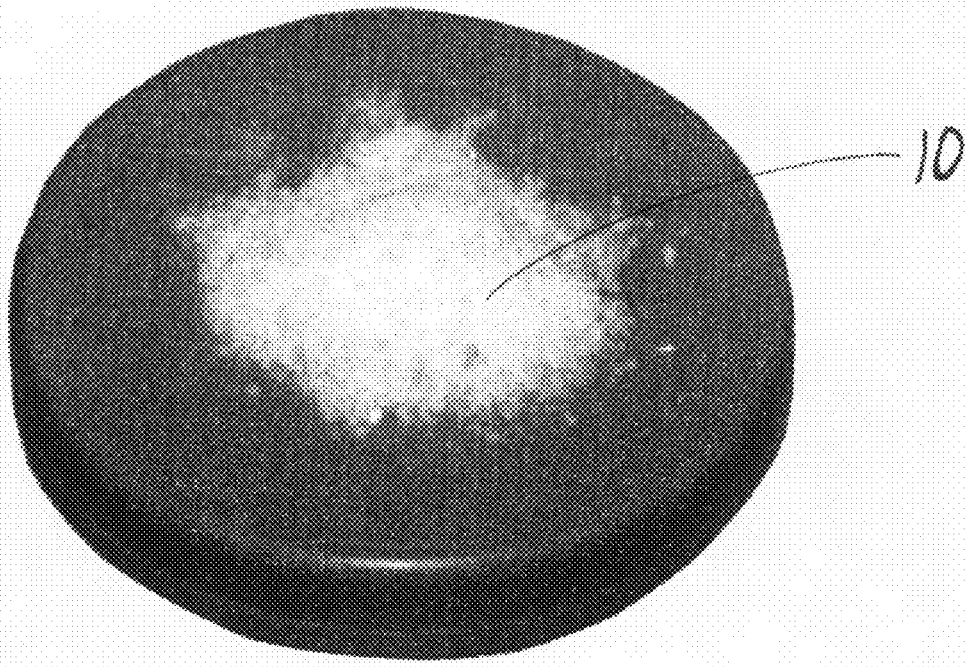
FIG. 1 (PRIOR ART)
FIG. 1 is a photograph of acetone peroxide, a white crystalline solid (Prior Art).

For purposes of discussion, TATP is used in the examples herein, but it is understood that the invention is not limited to the degradation of TATP, but should include the known family of explosive peroxides. The present invention provides in situ methodologies for the safe degradation of triacetone triperoxide 10, a white, solid crystalline substance as shown in FIG. 1.

It has been discovered that nano and micron sized metal particles, either neat or encapsulated in an emulsion, can degrade TATP at rates that approach half-lives of 30 minutes. Several different metal particle systems include, pure iron (both nano and micron sizes), pure micron size magnesium particles, iron and magnesium particles that have been activated by ball milling palladium to their surface, and iron and magnesium particles that have been activated by ball milling nickel to the surface of the particles. In general, the bimetal particles that contain palladium or nickel have higher rates of TATP degradation than the pure iron and magnesium particles.

Two different types of emulsions were used with the reactive metal particles. One of the emulsions was made with toluene and a nonionic surfactant and the second type of emulsion was made with corn oil and a nonionic surfactant. Both of the emulsions dissolve and safely degrade TATP crystals. The toluene emulsion produced complete TATP degradation within 24 hours and the corn oil emulsion within 48 hours.

No measurable temperature rises were observed to occur when using either the neat metals or the EZVM systems. Kinetic data demonstrates that the rate of TATP degradation follows pseudo-first order kinetics. Mechanistic pathway studies confirm that acetone is the major byproduct with two moles of acetone being produced for every mole of TATP that is degraded.

Thus, the TATP degradation methodologies of the present invention safely degrade TATP in any physical state where it is found. For example, TATP found in a container where it has been prepared will be present in a solution with TATP crystals at the bottom of the container, a water phase and some smaller TATP crystals floating on the top of the water phase; this TATP sample is degraded by either adding the neat bimetal particles to the container or by adding both an EZVM formulation that sinks and one that floats. TATP found to be present as dry crystals (in the solid state) are safely degraded when EZVM is spread over the crystals.

There are various embodiments of the composition of matter that are useful for safe, in situ degradation of explosive peroxides. Table I lists the key component in all compositions, a reactive metal particle in nano or micron size. The nano-size particles are in the range of from approximately 40 nanometers to approximately 100 nanometers (nm) in diameter; the micron-size particles are in the range of from approximately 1 micrometer to approximately 10 micrometers (μm) in diameter.

TABLE I

METALS USED TO DEGRADE TATP AND OTHER EXPLOSIVE PEROXIDES

| REACTIVE METALS | Nano-size | Micron-size |
|---|---|---|
| Iron (Fe) | 40-100 nm | 1-10 μm |
| Magnesium (Mg) | — | 1-3 μm |
| Copper (Cu) | 20-100 nm | 1-3 μm |
| Zinc (Zn) | — | 1-3 μm |
| Iron Palladium alloy (FePd) | 40-100 nm | 1-10 μm |
| Iron Nickel alloy (FeNi) | 20-100 nm | 1-3 μm |
| Magnesium Palladium alloy (MgPd) | — | 1-3 μm |
| Magnesium Nickel alloy (MgNi) | — | 1-3 μm |

Figure 2:
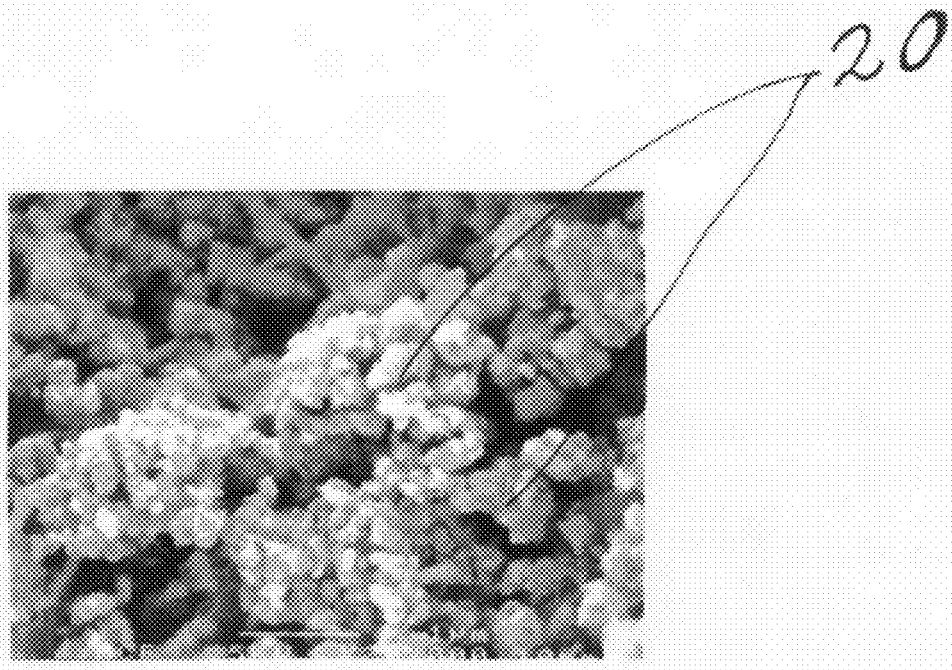
FIG. 2 is a scanning electron micrograph (SEM) of nanoscale iron particles (scale 1 μm).

The metal particles identified in Table I are suitable for use as neat particles or encapsulated in an emulsion to form a reactive system that can effectively and rapidly degrade TATP in a safe, controlled manner. FIG. 2 is a scanning electron micrograph (SEM) of pure iron nano particles 20 shown on a scale of 1 micrometer (μm).

Figure 3:
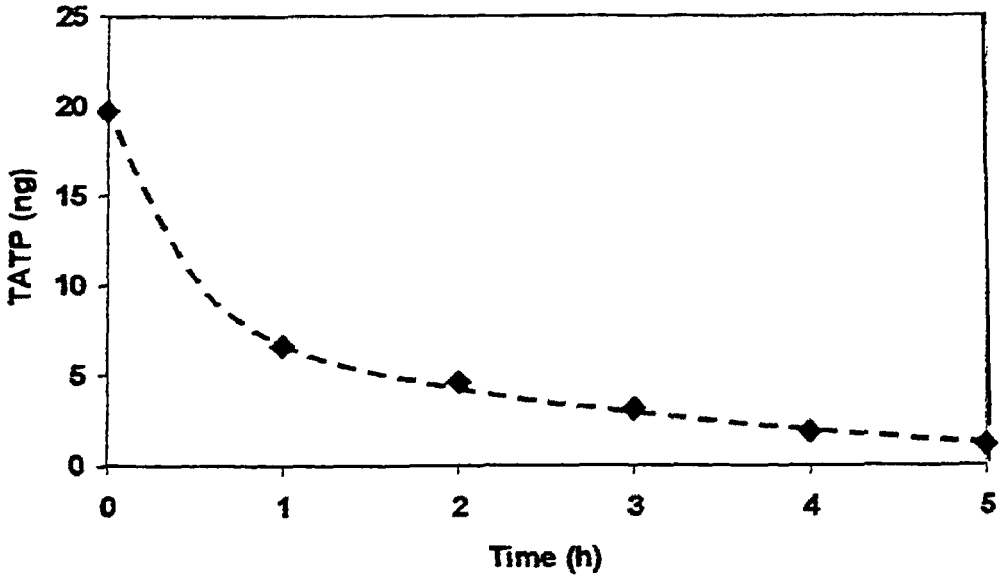
FIG. 3 is a graph of the degradation of triacetone triperoxide (TATP) in contact with neat zero-valent iron over a period of five hours.

FIG. 3 is a graph showing how 20 nanograms of TATP is degraded over a five hour period when in contact with neat nanoiron particles. At 25° C., 0.5 grams of zero valent iron nanoparticles are added to a TATP slurry consisting of 10 parts per million (ppm) TATP in 1 milliliter of water. The quantity of TATP is measured in the headspace with a 7.0 μm Polydimethylsiloxane (PDMS) Solid Phase MicroExtraction (SPME) fiber with samples taken at 30 second intervals. The half-life for degradation of the TATP present is 1.16 hours. Substantially all of the TATP is degraded safely and successfully in 5 hours. The analytical method used allows TATP analysis without disturbing the solution.

Figure 4:
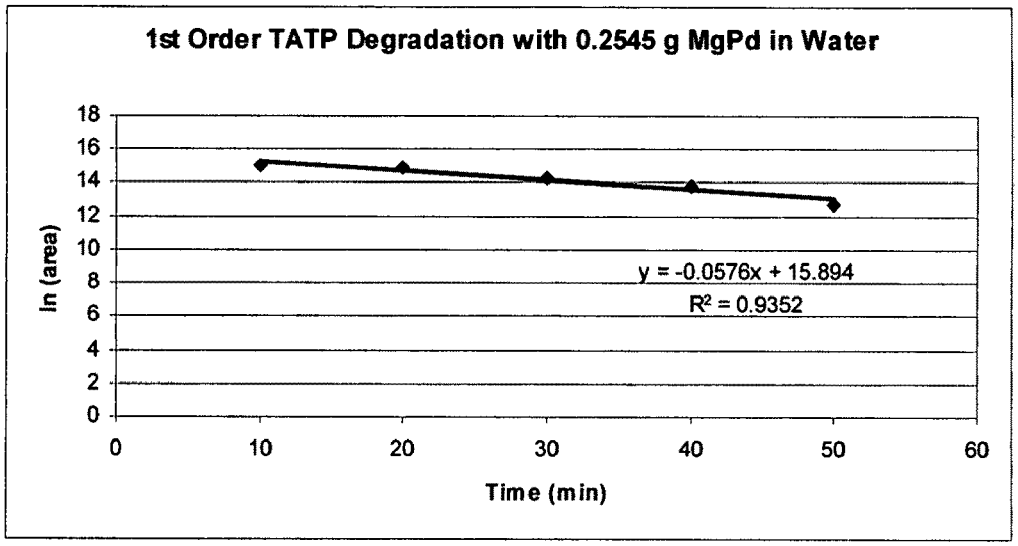
FIG. 4 shows the kinetic data of the degradation of TATP in water using neat magnesium palladium (MgPd) particles.

FIG. 4 shows kinetic data of the degradation of TATP in water using neat magnesium palladium (MgPd) particles. A water solution containing TATP crystals was used in the determination of the kinetics of degradation with ball-milled MgPd. One quarter gram of MgPd was allowed to react with TATP in a water solution with headspace above the water for testing the presence of TATP using a Solid Phase Microextraction Fiber (SPME). The SPME was desorbed in the injection port of a Gas Chromatograph-Mass Spectrometer for analysis. The concentration of TATP in the headspace sample was reduced by 84.8% using neat MgPd in 40 minutes. It was determined that degradation of TATP in water using the ball-milled magnesium palladium (MgPd) alloy follows pseudo first order kinetics.

Referring now to the emulsion system, hereinafter sometimes referred to as EZVM, the emulsion system is preferably formulated with food grade ingredients that are generally recognized as safe (GRAS) by the US Food and Drug Administration. The advantage of using food-grade ingredients is that when the spent emulsion is discarded, it is not classified as a hazardous waste. For example, a toluene emulsion is considered hazardous waste, whereas d-limonene or vegetable oil emulsions are not hazardous and disposal is less costly. The preferred emulsion composition is listed below in Table II:

TABLE II

Formulation for Emulsified Zero Valent Metals (EZVM)

| Ingredient | Wt. Percent Range | Preferred Wt. Percent |
|---|---|---|
| Nano and Micron Size Metal Particles | 5-20 | 16.3 |
| Nonionic Surfactant | 1-3 | 1.3 |
| Hydrophobic Solvent | 10-40 | 37.3 |
| Water | 10-50 | 45.1 |

Figure 5:
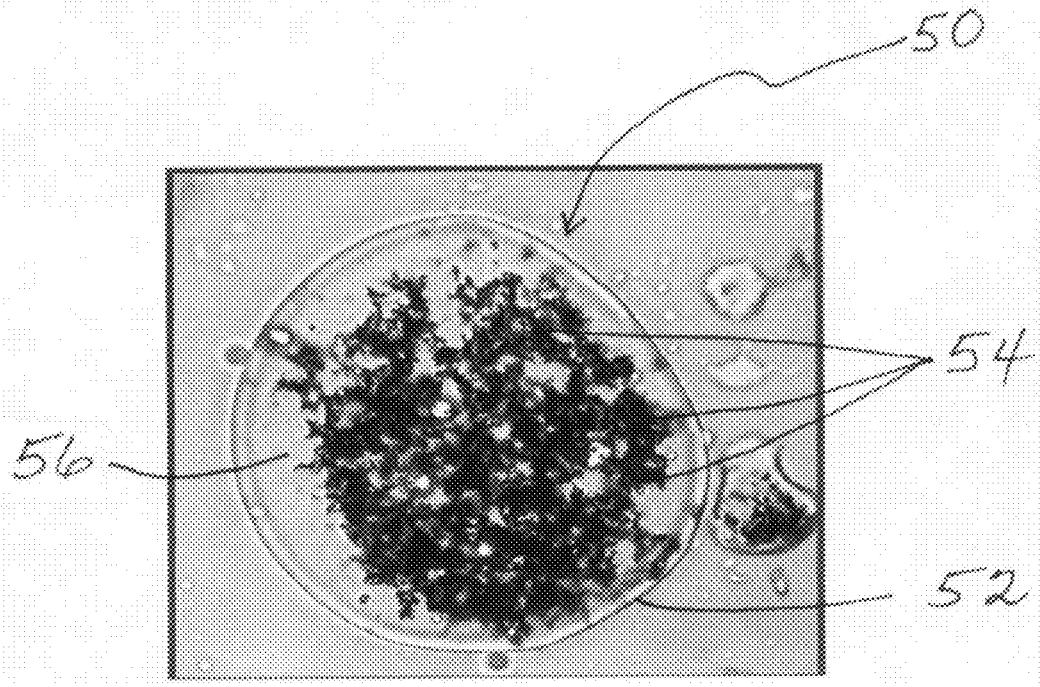
FIG. 5 is a microscopic image of an emulsified zero-valent metal (EZVM) droplet.

As shown in FIG. 5, each emulsion droplet 50 contains a hydrophobic outer layer 52 formed by the use of food-grade oils, d-limonene and organic solvents, such as toluene. The inside of the emulsion droplet 50 contains the reactive nanoparticles 54 in an aqueous environment 56.

The emulsion system is stabilized through the use of a food-grade, nonionic surfactant, such as, polyoxyethylene sorbitan monooleate, commercially available as TWEEN 80, or sorbitan trioleate, commercially available as SPAN 85. TWEEN 80 and SPAN 85 do not contribute any hazardous ingredients to the emulsion system; they both create a most stable and effective reductive emulsion that is stable for several months without any evidence of phase separation.

Nanoparticles are not the only reactive species that can be incorporated into the emulsion droplet 50. Any of the various complexing agents, such as, $Li^+$, $Cu^+$, $Zn^{2+}$, $Cd^{2+}$, and $In^{3+}$ can be added along with the nano-particles into the emulsion system.

FIG. 5 also confirms what is known about the production of liquid membranes as discussed by R. P. Cahn, et al. in "Separation of Phenol from Waste by the Liquid Membrane Technique," *Separation Science*, Vol. 9, pp. 505-509, 1974. The liquid membranes on the emulsion particle 50 can be made to have a spherical hydrophobic skin 52 and an aqueous hydrophilic interior 56. The nanoscale particles 54 are contained in the aqueous interior sphere 56. The TATP dissolves in the hydrophobic emulsion membrane 52 and then moves by diffusion into the aqueous interior 56. The reduction reaction rapidly takes place at the surface of the nanoparticle 54. FIG. 3 shows a nanoiron particle emulsion system 50 that can be delivered to a layer of TATP via dispersion of the emulsion in water and then gently sprayed on the surface of TATP.

The hydrophilic interior 56 of the emulsion droplet 50 can be adjusted to alter its dielectric properties and/or ionic strength. For example, the interior can be deionized water or it can contain various proportions of alcohols, such as methanol. The ionic strength of the hydrophilic phase can be adjusted by the addition of salts such as NaCl or potential reducing agents, such as CuI or $SnI_2$.

Example 1 below provides a description of a typical laboratory scale preparation of an emulsion (EZVM) formulation.

Example 1

Emulsion Formulation

A preferred emulsion formulation, wherein all percents are by weight, consists of approximately 45.1% water, approximately 37.3% organic phase or solvent, approximately 1.3% food-grade surfactant, such as sorbitan trioleate (SPAN 85), and approximately 16.3% nanosize metal particles assembled at room temperature (approximately 25° C.). Emulsion preparation consists of adding 100.0 mL of water to a high speed blender then adding 36 g of metal particles to the water while running the blender under a nitrogen blanket. The surfactant (2.94 g) is dissolved in 82.4 g of organic phase (such as, vegetable oil, d-limonene, or toluene). The organic phase is then slowly added to the aqueous phase while running the blender at maximum speed. After the organic phase has been added, the blender is allowed to run for an additional 5 minutes until a uniform emulsion has been produced. The emulsion is stored under a nitrogen blanket until it is ready for use.

Example 2

Procedure for Testing EZVM for Degradation of TATP Via a Toluene Emulsion

The following procedure was used to measure the rate of degradation of TATP crystals by our reactive emulsion systems that contain nanometer or micrometer size metal particles. The metal particles include iron and magnesium. The hydrophobic membrane of the emulsion droplet is made up of toluene and a nonionic surfactant. The inner part of the emulsion contains the metal particles and a hydrophobic phase consisting of different concentrations of methyl alcohol and water.

Figure 6:
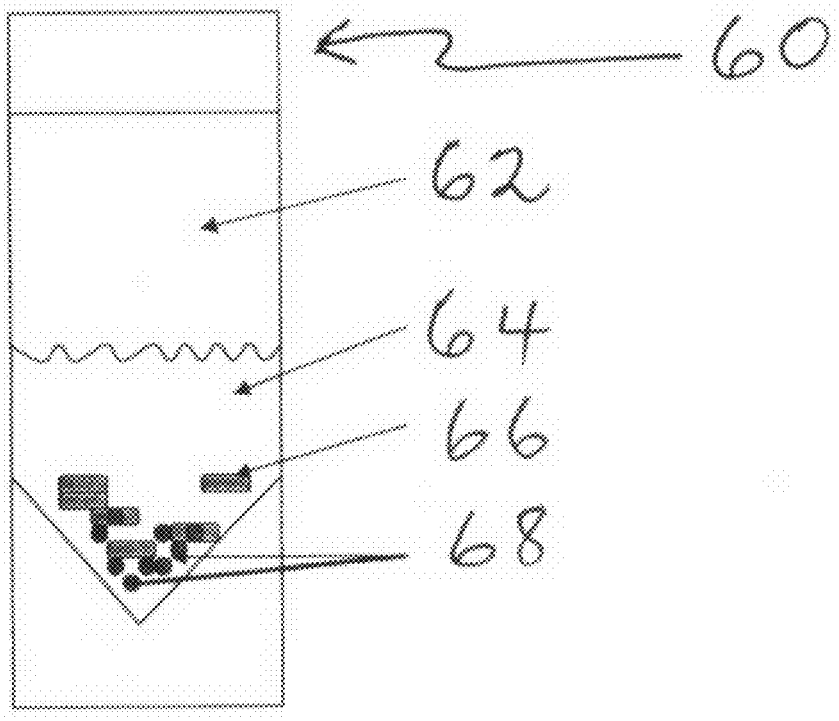
FIG. 6 is a schematic of the experimental set up used to measure the rate of degradation of TATP crystals by the reactive emulsion system of the present invention.

FIG. 6 is a schematic of the set up for measuring the rate of degradation of TATP. A capped glass vial 60 is used that has headspace 62 for sampling TATP using the solid-phase microextraction (SPME) fiber and the gas chromatography-mass spectrometry (GC-MS) or gas chromatography—flame ionization detector (GC-FID) method. Vial 60 contains a water continuum 64, reactive emulsion droplets 66, and less than 10 milligrams of TATP crystals 68. Change in the size of the TATP crystals is also documented by optical microscopy. The vial is not shaken and is handled with a minimum amount of motion during sampling and microscopic documentation. The purpose of this procedure is to simulate as closely as possible the field application of the emulsion for TATP degradation.

Once TATP crystals are no longer present and the TATP concentration in the headspace has dropped to below detection levels, the emulsion 66 is removed from the test vial 60. The emulsion 66 is then broken, washed with methanol and analyzed for the presence of TATP. The purpose of this step is to document whether the emulsion really degraded the TATP or merely adsorbed it into the interior of the emulsion droplet. Generally, no TATP is detected within the emulsion 66 after two days.

Example 3

Degradation Testing of TATP by Reactive Emulsion Systems

Various emulsion systems were tested for TATP degradation ability by using the following procedure. A 100 mg portion of TATP was placed in a 10 mL crimp top vial. To the vial was added 5 mL of test emulsion. The vial was sealed with a septa and a hypodermic needle was inserted through the septa and connected to a gas bubbler. For each test emulsion 5 separate vials were set up. The vials were placed on a low velocity shaking platform and the bubblers observed for gas generation, both rate and quality. After selected time intervals, each vial was visually analyzed for TATP disappearance and one vial at each selected time was opened up and the contents analyzed for the presence of TATP and its degradation products. Initial time periods were established based upon the rate of visual disappearance of TATP. For example, if all of the TATP crystals were gone after one hour then it was necessary to sample every 15 minutes. On the other hand, if the disappearance occurred over several hours, then the sample time intervals were lengthened.

For each test emulsion a second series of test vials were set up. These were setup as follows. A 100 mg portion of TATP was placed in a 10 mL crimp top vial. The test emulsion, 4 mL, was dispersed into 4 mL of water. This 8 mL dispersion was then added to the vial before it is sealed and tested as described for the test procedure using the neat test emulsion.

The analysis of the test emulsions for the presence of TATP was accomplished by the use of analytical procedures developed by Bellamy and reported in *J. Forensic Sci.* 1999, 44(3), 603-608; said procedures are incorporated herein by reference. The method consists of analyzing an extract of the emulsion test mixture, using either toluene or ethyl acetate, depending on what the organic phase of the emulsion is made of. The extract is then spotted onto a Merck precoated silica gel $60F_{2541}$ 0.25 mm TLC plate. The development solvent is toluene and the spray reagent is 1% diphenylamine in conc. $H_2SO_4$. The $R_f$ value for TATP is 0.57. TATP that is synthesized with a $H_2SO_4$ catalyst often has as a contaminant diacetone diperoxide (DADP). The presence of DADP in the emulsion sample can also be detected by the TLC test because it has a $R_f$ value of 0.66.

Two different quantitative techniques were used to analyze the emulsion extracts for the presence of TATP and DADP and their degradation products. One of the techniques consists of a gas chromatography, GC, method that was developed by Bellamy, supra. It consists of using a CO-SIL-8CB column, 1.0 μm coating, 0.33 mm ID, 25 m long and a temperature program of 50° C. (1 min) then increasing at 10 K $min^{-1}$ to 250° C. (10 min). The RT values for these conditions are TATP 9.65 min and DADP 5.15 min.

The second quantitative method that was used is a liquid chromatography/mass spectrometry (LC-MS) methodology, an analysis technique developed for several other explosive substances.

In all analytical methods, the degradation of TATP and DADP is confirmed.

Example 4

Degradation Testing of TATP Film Deposits by a Reactive Emulsion System

To develop an onsite methodology for degrading TATP, a laboratory scale version of the envisioned field scale application was tested. The experimental procedure consisted of placing a thin layer of TATP onto a synthetic fluorine-containing resin, such as a commercially available TEFLON® pad. The amount of TATP that was used to create this film was approximately 0.5 gram. The TATP film was then treated with the reactive emulsion. The treatment consisted of dispersing the emulsion into water and then spraying this mixture onto the TATP. Samples were taken from the surface of the TEFLON® pad at measured time intervals and analyzed for the presence of TATP and its degradation byproducts by the same analytical experiments used in the vial studies. The purpose of these experiments was to develop a correlation between the time it takes for complete degradation of the TATP versus the thickness of the TATP deposit. Data were also provided on the amount of emulsion that is required to treat a given area that is contaminated with TATP.

Example 5

Degradation of TATP Crystals by a Reactive Emulsion System

FIGS. 7A to 7F are drawings of micrographs showing the rate at which TATP crystals are absorbed into an emulsion droplet in contact with a reactive emulsion system 100 on a Petri dish 70. The objects shown in the micrograph are magnified approximately twenty times the actual size.

Figure 7A:
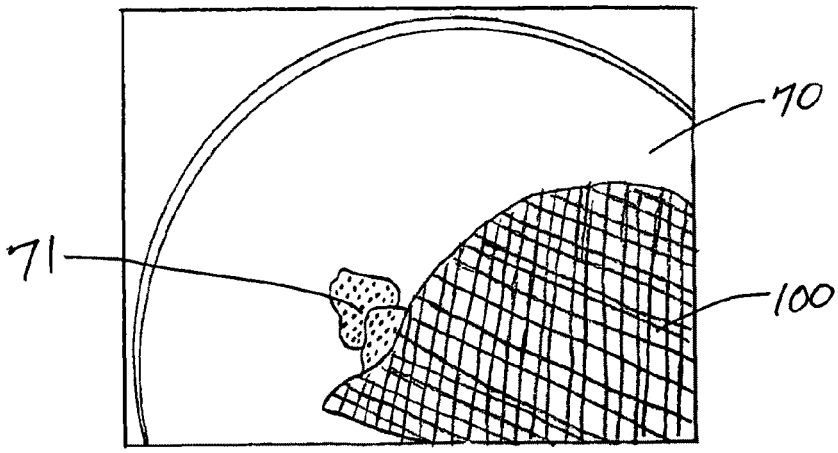
FIG. 7A is a graphic depiction of TATP crystals after 30 seconds of contact with a nano-iron emulsion droplet.
Figure 7B:
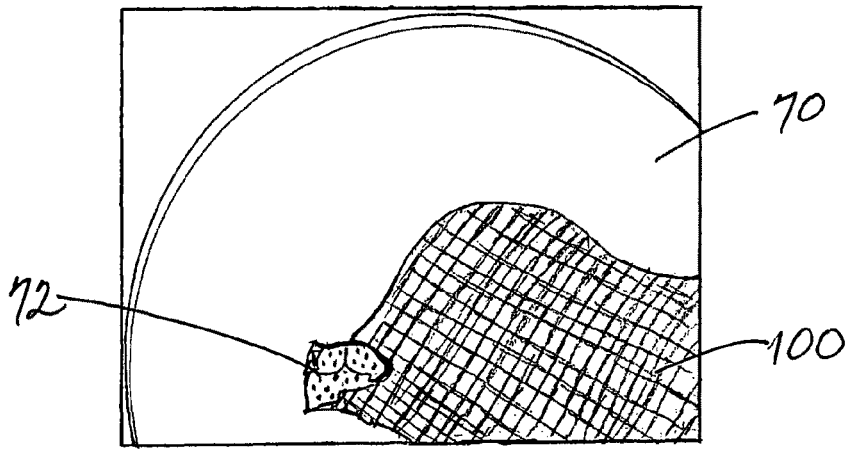
FIG. 7B is a graphic depiction of TATP crystals of FIG. 7A after 9 minutes 30 seconds of contact with a nano-iron emulsion droplet.
Figure 7C:
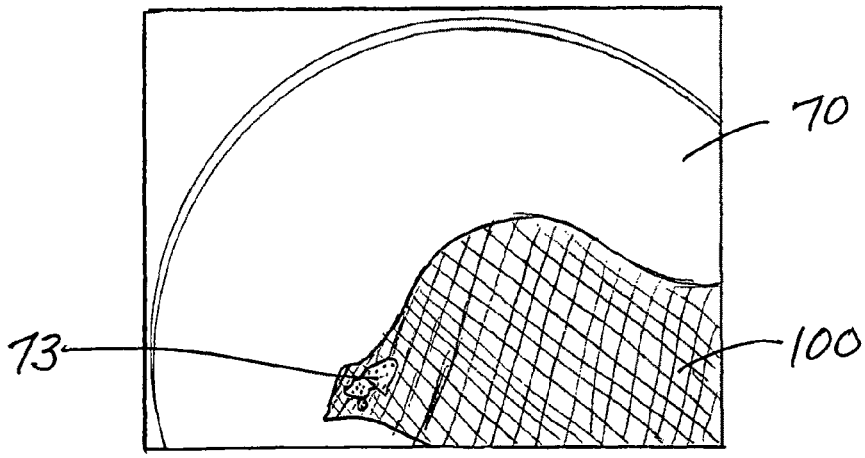
FIG. 7C is a graphic depiction of TATP crystals of FIG. 7A after 20 minutes of contact with a nano-iron emulsion droplet.
Figure 7D:
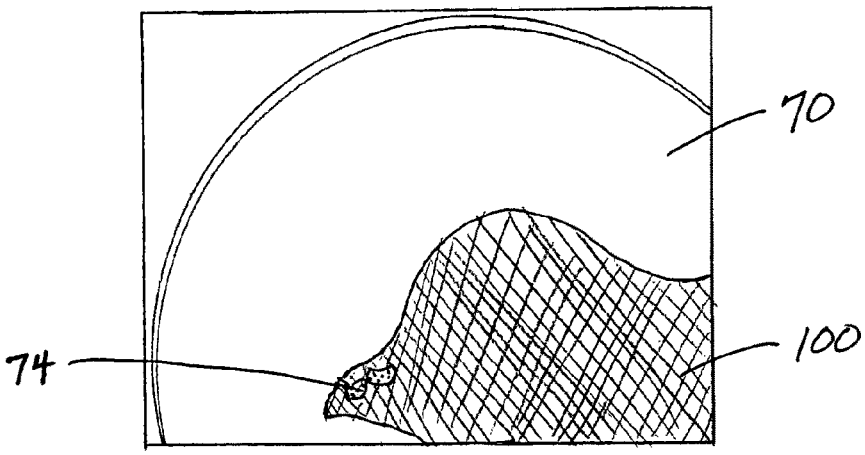
FIG. 7D is a graphic depiction of TATP crystals of FIG. 7A after 28 minutes of contact with a nano-iron emulsion droplet.
Figure 7E:
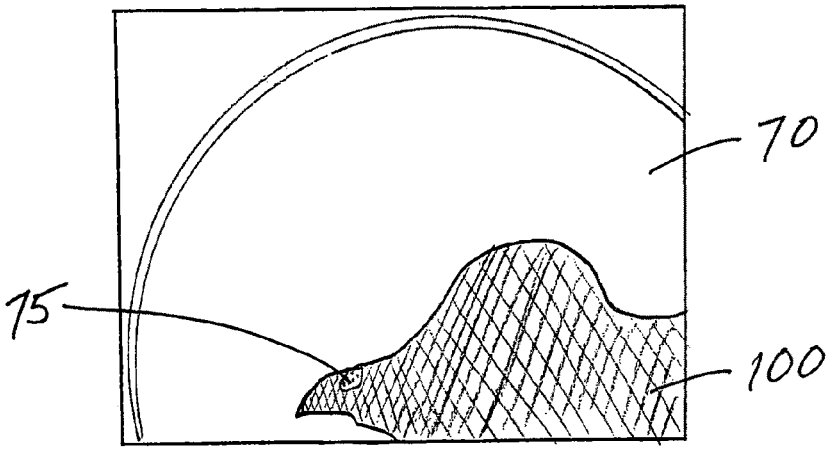
FIG. 7E is a graphic depiction of TATP crystals of FIG. 7A after 31 minutes of contact with a nano-iron emulsion droplet.
Figure 7F:
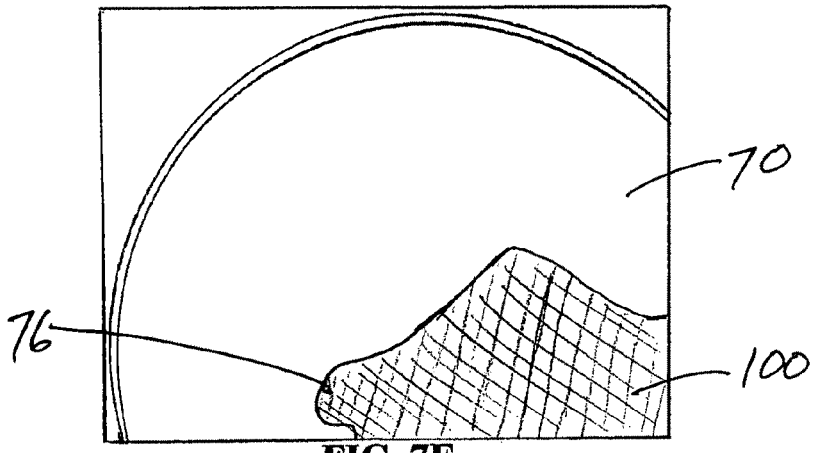
FIG. 7F is a graphic depiction of TATP crystals of FIG. 7A after 32 minutes of contact with a nano-iron emulsion droplet.

FIG. 7A shows the TATP crystal 71 after thirty seconds of contact with the reactive emulsion system 100. FIG. 7B shows a smaller TATP crystal 72 after 9 minutes and 30 seconds of contact with the emulsion 100. After 20 minutes the TATP crystal 73 is smaller. There is a progression of less and less TATP crystal as shown in FIG. 7D, crystal 74, after 28 minutes; FIG. 7E, crystal 75, after 31 minutes; and in FIG. 7F there is barely a trace of the TATP crystal 76, after 32 minutes. FIGS. 7A-7F illustrate the safe, in situ degradation of TATP by the reactive emulsion system of the present invention.

The present invention provides a composition of matter and method for using the composition of matter to safely remediate in situ, an area contaminated with explosive substances in the peroxide family.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A composition of matter useful in degrading explosive peroxides consisting essentially of:

a liquid medium; and a plurality of nano and micron sized metal particles selected from the group consisting of magnesium, copper, zinc and mixtures thereof in an elemental state in contact with an explosive peroxide wherein the plurality of metal particles is in the liquid medium that disperses and facilitates the contact between the plurality of metal particles and the explosive peroxide resulting in the degradation of the explosive peroxide.

2. The composition of claim 1, wherein the plurality of nano and micron sized metal particles further comprises bimetallic alloys of an elemental metal and a metal hydrogenation catalyst selected from the group consisting of iron nickel alloy (FeNi), magnesium palladium alloy (MgPd) and magnesium nickel alloy (MgNi).

3. The composition of claim 1, wherein the liquid medium is selected from the group consisting of water and an emulsion droplet comprising water, a hydrophobic solvent and a nonionic surfactant.

4. The composition of claim 3, wherein the liquid medium is water.

5. The composition of claim 3, wherein the hydrophobic solvent of the emulsion droplet is selected from the group consisting of vegetable oil, d-limonene and toluene.

6. The composition of claim 5, wherein the vegetable oil is corn oil.

7. The composition of claim 3, wherein the nonionic surfactant is a food-grade surfactant selected from the group consisting of polyoxyethylene sorbitan monooleate and sorbitan trioleate.

8. The composition of claim 1, wherein the formulation consists of approximately 45% water, approximately 37% solvent, approximately 2% surfactant and approximately 16% metal particles, whereby all percents are by weight.

9. The composition of claim 1, wherein the peroxide explosive is triacetone triperoxide.

10. The composition of claim 1, wherein the plurality of nano and micron sized metal particles in an elemental state is magnesium and the liquid medium is an emulsion droplet of toluene and a nonionic surfactant and an inner part of the emulsion contains the metal particles and a hydrophobic phase consisting of methyl alcohol and water.

11. The composition of claim 1, wherein the plurality of nano and micron sized metal particles in an elemental state is copper and the liquid medium is an emulsion droplet of toluene and a nonionic surfactant and an inner part of the emulsion contains the metal particles and a hydrophobic phase consisting of methyl alcohol and water.

12. The composition of claim 1, wherein the plurality of nano and micron sized metal particles in an elemental state is zinc and the liquid medium is an emulsion droplet of toluene and a nonionic surfactant and an inner part of the emulsion contains the metal particles and a hydrophobic phase consisting of methyl alcohol and water.

13. The composition of claim 2, wherein the bimetallic alloy of an elemental metal and a metal hydrogenation catalyst is iron nickel alloy (FeNi) and the liquid medium is water.

14. The composition of claim 2, wherein the bimetallic alloy of an elemental metal and a metal hydrogenation catalyst is magnesium palladium alloy (MgPd) and the liquid medium is water.

15. The composition of claim 2, wherein the bimetallic alloy of an elemental metal and a metal hydrogenation catalyst is magnesium nickel alloy (MgNi) and the liquid medium is water.

16. A composition of matter useful in degrading explosive peroxides consisting essentially of:

a plurality of neat nano and micron sized metal particles in an elemental state selected from the group consisting of magnesium, copper, zinc and mixtures thereof in contact with an explosive peroxide wherein the plurality of metal particles facilitates safe, in-situ degradation of the explosive peroxide.

17. The composition of claim 16, wherein the explosive peroxide is triacetone triperoxide.

18. A composition of matter useful in degrading explosive peroxides consisting essentially of:

a plurality of neat nano and micron sized bimetallic alloys of an elemental metal and a metal hydrogenation catalyst selected from the group consisting of iron nickel (FeNi), magnesium palladium (MgPd), and magnesium nickel (MgNi) in contact with an explosive peroxide wherein the plurality of bimetallic alloy particles facilitates safe, in-situ degradation of the explosive peroxide.

19. The composition of claim 18, wherein the explosive peroxide is triacetone triperoxide.

* * * * *